United States Patent [19]

Olsen

[11] Patent Number: 4,679,987

[45] Date of Patent: Jul. 14, 1987

[54] SELF-PRIMING LIQUID RING PUMP METHODS AND APPARATUS

[75] Inventor: Ole B. Olsen, Newtown, Conn.

[73] Assignee: The Nash Engineering Company, Norwalk, Conn.

[21] Appl. No.: 864,269

[22] Filed: May 19, 1986

[51] Int. Cl.[4] ..... F04C 19/00

[52] U.S. Cl. ..... 417/54; 417/68

[58] Field of Search ..... 417/54, 68, 69

[56] References Cited

U.S. PATENT DOCUMENTS

| | | | |
|---|---|---|---|
| 1,322,363 | 11/1919 | Siemen et al. | 417/68 |
| 2,195,174 | 3/1940 | Jennings | 417/68 |
| 2,195,375 | 3/1940 | Adams | 417/54 |
| 3,032,258 | 5/1962 | Jennings | 417/68 |
| 3,721,508 | 3/1973 | Mugele | 417/68 |
| 3,973,879 | 8/1976 | Ramm | 417/69 |
| 4,083,658 | 4/1978 | Ramm | 417/68 |
| 4,521,161 | 6/1985 | Olsen et al. | 417/68 |
| 4,545,730 | 10/1985 | Lubke | 417/68 |

FOREIGN PATENT DOCUMENTS

| | | | |
|---|---|---|---|
| 258483 | 4/1913 | Fed. Rep. of Germany | 417/68 |
| 258854 | 4/1913 | Fed. Rep. of Germany | 417/68 |
| 40260 | 3/1913 | Sweden | 417/68 |
| 809294 | 2/1959 | United Kingdom | 417/68 |
| 914809 | 3/1982 | U.S.S.R. | 417/68 |

*Primary Examiner*—Carlton R. Croyle
*Assistant Examiner*—Paul F. Neils
*Attorney, Agent, or Firm*—Robert R. Jackson

[57] ABSTRACT

Stalling of liquid ring pumps during start-up is prevented, without the need for a separate liquid pump or other means for initiating or sustaining the flow of make-up pumping liquid into the pump, by providing a bypass conduit for initially conveying some pumping liquid from the relatively high liquid pressure side of the pump to the relatively low liquid pressure side of the pump. This helps the pump establish the internal liquid distribution needed to form a viable liquid ring and create the gas pressure differential necessary to initiate and sustain the inflow of make-up pumping liquid.

14 Claims, 10 Drawing Figures

10
12
14
16
18
20
22
24
38
40
42
44
46
50a
50b
50c
60
96
2
2
A
A

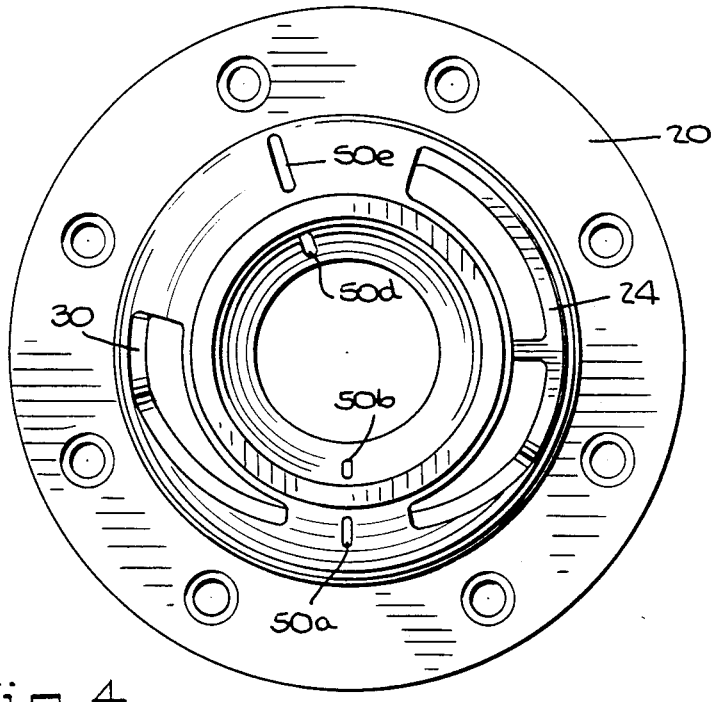
Fig. 4.
Fig. 5.
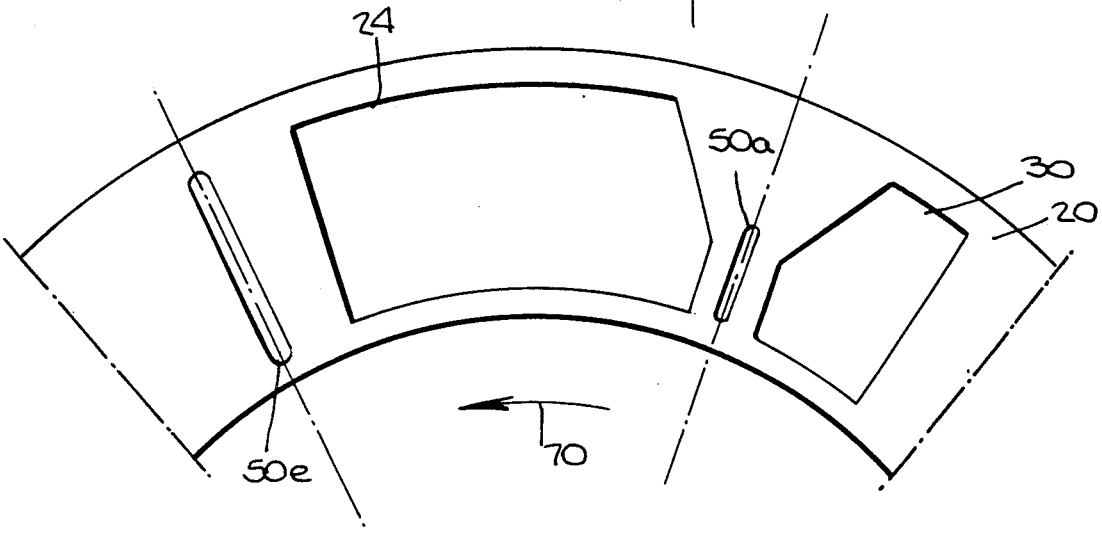

SELF-PRIMING LIQUID RING PUMP METHODS AND APPARATUS

BACKGROUND OF THE INVENTION

This invention relates to liquid ring gas pumps.

Liquid ring gas pumps generally require a substantially continuous inflow of fresh or recirculated pumping liquid (sometimes referred to as "make-up" pumping liquid) to replace the pumping liquid that is normally lost via the gas discharge port. This flow of pumping liquid through the pump is also used to absorb some of the heat generated in the pump, thereby preventing the pump from overheating. A substantially continuous inflow of make-up pumping liquid is therefore essential to successful operation of a liquid ring pump.

In many liquid ring pump installations, the major portion of the pumping liquid inflow is pumping liquid that has been recirculated from the discharge port of the pump. In general, such recirculating flow must be at least partially propelled by a separate liquid pump. This increases the cost and complexity of the system. It also decreases the reliability of the system to the extend that the separate liquid pump is subject to failure. Even if such a separate liquid pump is not required to maintain pumping liquid recirculation during normal operation of the liquid ring pump, it may be difficult or impossible to start the liquid ring pump successfully without a separate liquid pump to initiate the flow of pumping liquid into the pump during start-up.

In view of the foregoing, it is an object of this invention to provide liquid ring pumps that are self-priming, i.e., liquid ring pumps that can themselves initiate and sustain a recirculating flow of pumping liquid partly external to the pump (and create a properly formed internal liquid ring utilizing this liquid) without the need for a separate liquid pump.

It is another object of this invention to provide methods for operating liquid ring pumps so that they are self-priming, particularly during start-up.

As shown in German Pat. No. 258,483, it is known that the volumetric efficiency of liquid ring gas pumps can be improved by providing a conduit for causing gas that would otherwise be carried over from the compression zone to the intake zone ("carry-over" gas) to instead bypass the intake zone. (As used herein, the term "gas" refers to the largely gaseous and/or vaporous medium being pumped by the liquid ring pump.) In practice, however, it is extremely difficult or impossible to cast or otherwise form bypass conduits of the type shown in the German patent in the port members of conically or cylindrically ported liquid ring pumps.

It is therefore another object of this invention to provide improved bypass conduit configurations for conically and cylindrically ported liquid ring pumps.

It is still another object of this invention to provide liquid ring pumps having both a bypass conduit and self-priming operation.

It is yet another object of this invention to provide methods of operating liquid ring pumps so that the bypass conduit of the pump additionally renders the pump self-priming.

SUMMARY OF THE INVENTION

These and other objects of the invention are accomplished in accordance with the principles of the invention by providing liquid ring pumps having a bypass conduit, the inlet (but not the outlet) of which is immersed in pumping liquid when the pump is at a standstill ready to be started. When the pump is first started, typically before the liquid ring has properly formed and created sufficient suction to pull recirculated pumping liquid into the pump, the relatively high pressure of the pumping liquid adjacent the bypass conduit inlet causes pumping liquid to flow through the bypass conduit from its inlet to its outlet. This "bypass pumping liquid" is believed to promote successful pump operation in two ways. First, it helps seal the pump between its intake and discharge ports even through the liquid ring may be somewhat depleted due to the temporary initial absence of pumping liquid inflow. Second, a portion of this bypass pumping liquid is added to the nascent liquid ring in the compression zone, thus enhancing formation of a stable liquid ring.

The enhanced sealing and liquid ring formation apparently provided by the bypass pumping liquid is believed to help the pump to pump sufficient gas to begin to establish a gas pressure differential between the intake and discharge ports of the pump. Once such a gas pressure differential has been established, the relatively low pressure in the pump begins to pull recirculated pumping liquid into the pump, thereby establishing and subsequently maintaining the inflow of recirculated pumping liquid necessary for continued full operation of the pump. In addition, all or a major portion of any carry-over gas reaching the bypass conduit inlet flows through the bypass conduit, thereby bypassing the intake zone of the pump and improving the volumetric efficiency of the pump.

In a preferred embodiment of the invention in a conically or cylindrically ported liquid ring pump, the bypass conduit comprises a clearance between the rotor shaft and the port member, a first aperture through the port member from the bypass conduit inlet on the outer surface of the port member to the clearance, and a second aperture through the port member from the clearance to the bypass conduit outlet on the outer surface of the port member. The recirculated pumping liquid inlet is also connected to the clearance.

In a preferred embodiment of the invention in a side ported or "flat sided" liquid ring pump, the bypass conduit comprises a circumferential or partly circumferential passageway in the port member, a first aperture through the port member from the bypass conduit inlet on the inner (rotor side) surface of the port member to the passageway, and a second aperture through the port member from the passageway to the bypass conduit outlet also on the inner surface of the port member.

Further features of the invention, its nature and various advantages will be more apparent from the accompanying drawings and the following detailed description of the invention.

BRIEF DESCRIPTION OF THE DRAWINGS

FIG. 4 is an end view of the port member of FIG. 3.

FIG. 5 is a planar projection of the outer surface of the port member of FIGS. 3 and 4.

DETAILED DESCRIPTION OF THE PREFERRED EMBODIMENTS

Figure 1:
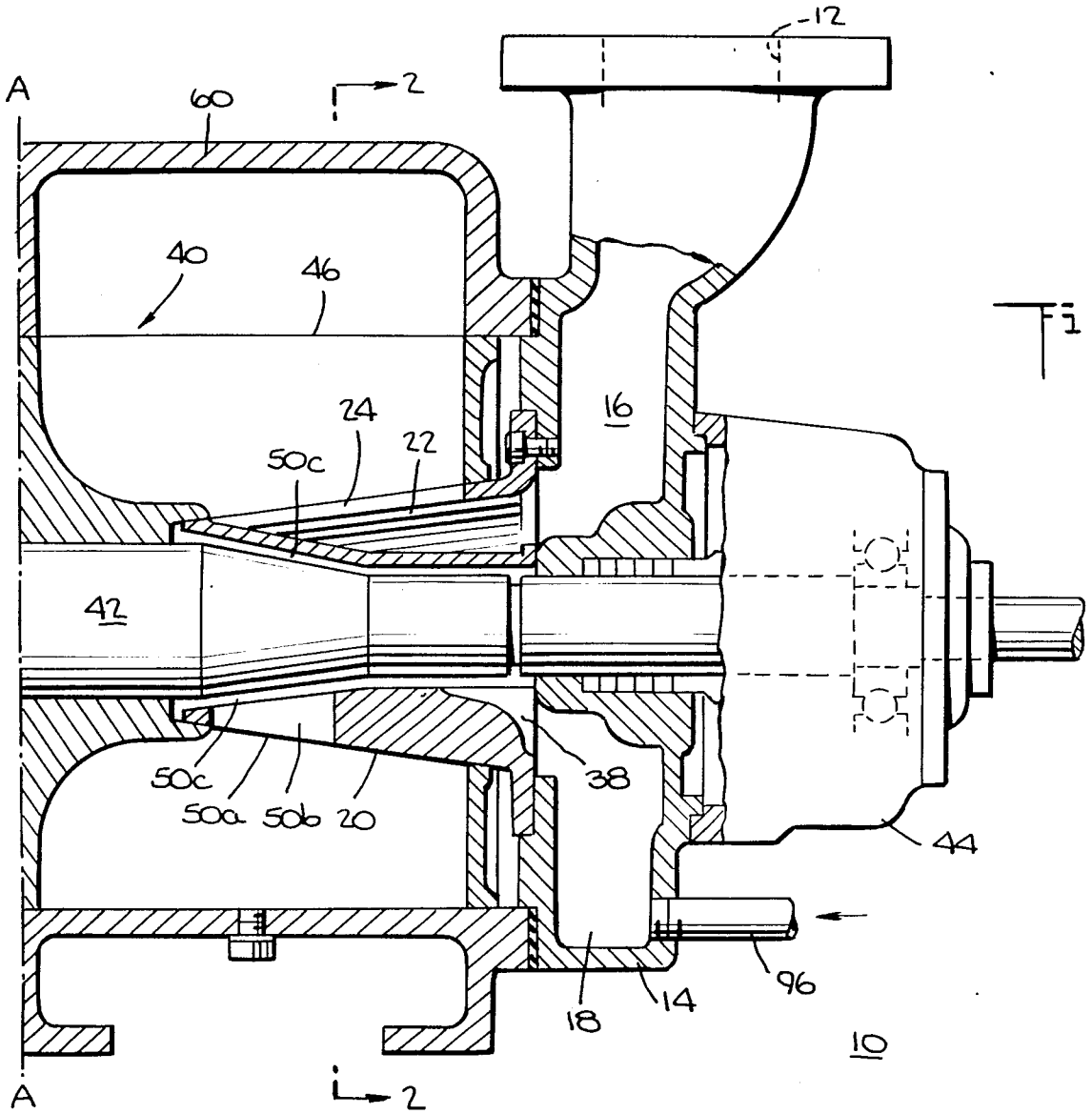
FIG. 1 is a partly sectional, partial elevational view of a conically ported liquid ring pump constructed in accordance with the principles of this invention. The sectional portion of FIG. 1 is taken along the line 1—1 in FIG. 2.

As shown in FIG. 1, a concially ported liquid ring pump 10 constructed in accordance with the principles of this invention includes rotor 40 rotatably mounted in stationary annular housing 60. Rotor 40 is fixedly mounted on shaft 42 which is rotatably mounted in bearing assemblies 44 adjacent each end of housing 60 (only one end of which is shown in FIG. 1). Gas to be pumped enters the pump via inlet opening 12 in head number 14. Inside head member 14, the gas flows via conduit 16 into conduit 22 in stationary conical port member 20. (Although port member 20 is actually frustoconical, those skilled in the art typically refer to such port members as conical.) Port member 20 extends into an annular clearance between shaft 42 and one end portion of rotor 40. Gas from conduit 22 flows into the spaces between rotor blades 46 via intake port 24 in what is called the intake zone 26 of the pump (see FIG. 2). In cooperation with the pumping liquid (not shown but entirely conventional) in housing 60, rotor 40 (rotating in the direction indicated by arrow 70) conveys the gas from intake zone 26 to compression zone 28, simultaneously compressing the gas thus conveyed. The compressed gas exits from compression zone 28 via discharge port 30, port member conduit 32, and head member and housing conduit 34, ultimately exiting from the pump via outlet opening 36.

The structure shown in FIG. 1 may comprise substantially the entire liquid ring pump (with only the addition of a cover structure and bearing assembly to the left of match line A—A in FIG. 1). Alternatively, the structure shown in FIG. 1 may be duplicated in mirror image to the left of match line A—A to produce a double-ended pump. As yet another alternative, a similar but smaller second-stage pump structure may be provided to the left of match line A—A to produce a two-stage pump with outlet opening 36 being connected to the inlet opening of the second stage.

In accordance with the principles of this invention, any compressed gas that is not discharged from rotor 40 via discharge port 30 bypasses intake zone 26 by flowing through bypass conduit 50 (comprising inlet 50*a*, initial portion 50*b*, clearance 50*c*, final portion 50*d*, and outlet 50*e*). Inlet 50*a* is an aperture in the outer surface of port member 20 which is radially opposite the "land" region of the pump (i.e., the point at which the tips of rotor blades 46 are closest to the inner surface of housing 60). From inlet 50*a*, the initial portion 50*b* of conduit 50 extends radially through port member 20 to an annular clearance 50*c* between the annular inner surface of port member 20 and the annular outer surface of shaft 42. From clearance 50*c*, the final portion 50*d* of conduit 50 again extends radially through port member 20 to outlet aperture 50*e* on the outer surface of port member 20. Outlet aperture 50*e* is located after intake port 24 but before discharge port 30 in the direction of rotor rotation. Accordingly, carry-over gas that would otherwise enter intake zone 26 (and thereby reduce the volumetric efficiency of the pump) is caused instead to bypass intake zone 26 by flowing through conduit 50.

Figure 6:
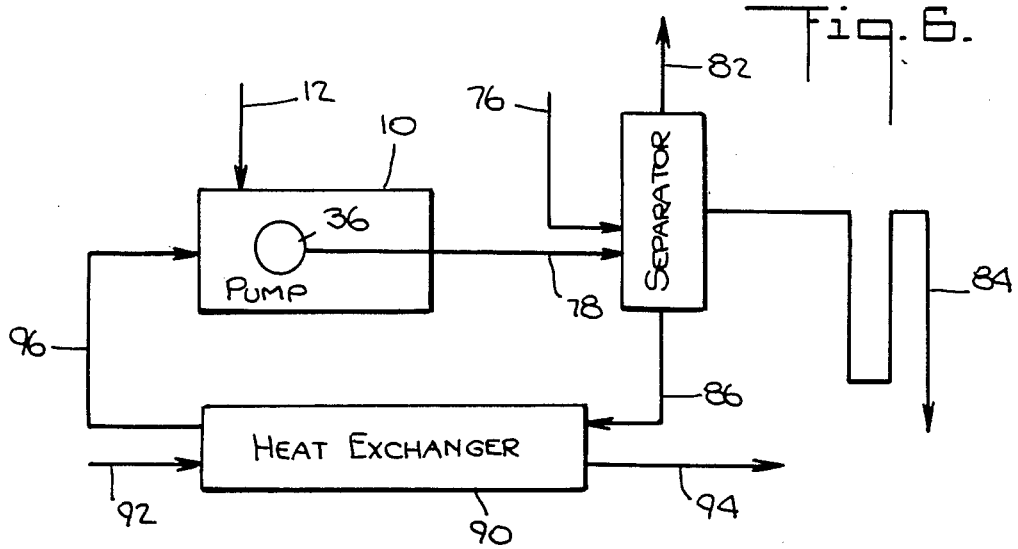
FIG. 6 is a schematic diagram of a typical liquid ring pump installation employing the liquid ring pump of FIGS. 1-5 or, alternatively, the liquid ring pump of FIGS. 7-10.

In a typical installation of pump 10 as shown in FIG. 6, compressed gas and excess pumping liquid discharged from the pump via outlet 36 are conveyed to separator 80 via conduit 78. Separator 80 separates the gas (discharged via conduit 82) from the liquid. Liquid in excess of a predetermined maximum amount is discharged from the system via waste conduit 84. Usually, this type of discharge will only occur during start-up of the pump. The liquid retained in the system flows from separator 80 to heat exchanger 90 via conduit 86. Heat exchanger 90 cools the liquid by heat exchange with a cooling medium (e.g., air or water) supplied to heat exchanger 90 via conduit 92 and discharged from the heat exchanger via conduit 94. The cooled pumping liquid is recirculated from heat exchanger 90 to pump 10 via conduit 96 (see also FIG. 1). Any required make-up pumping liquid is supplied to the system via conduit 76, the flow from which is typically controlled by a float valve (not shown) in separator 80.

As shown in FIG. 1, conduit 96 preferably communicates with clearance 50*c* via conduit 18 in head member 14 and conduit 38 in port member 20. The angular location of elements 96, 18, and 38 is not critical and can be selected to suit the convenience of the designer.

It should be noted that, in accordance with this invention, no liquid pump is required to impel the recirculation of pumping liquid in the system of FIG. 6.

Figure 2:
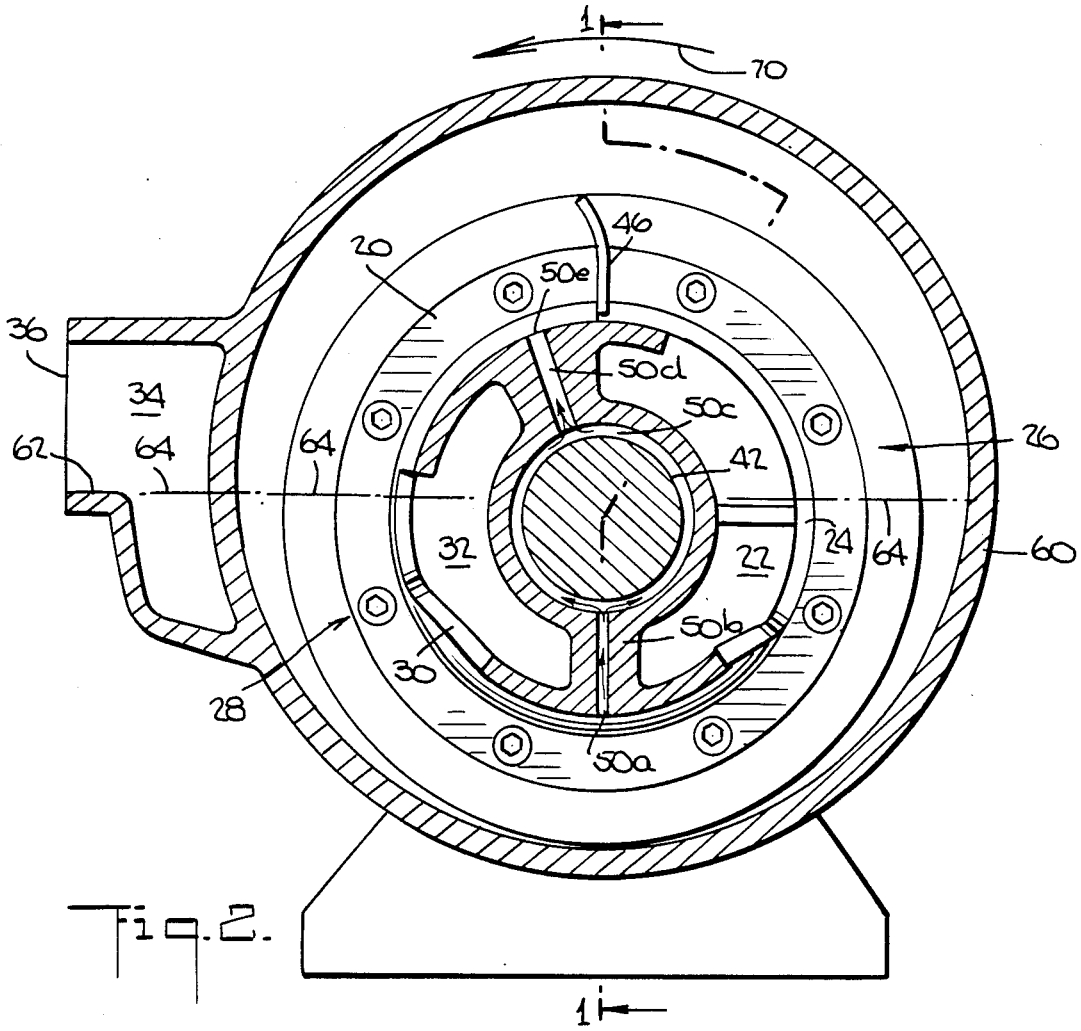
FIG. 2 is a simplified cross sectional view taken along the line 2—2 in FIG. 1 with the rotor of the pump largely removed.
Figure 3:
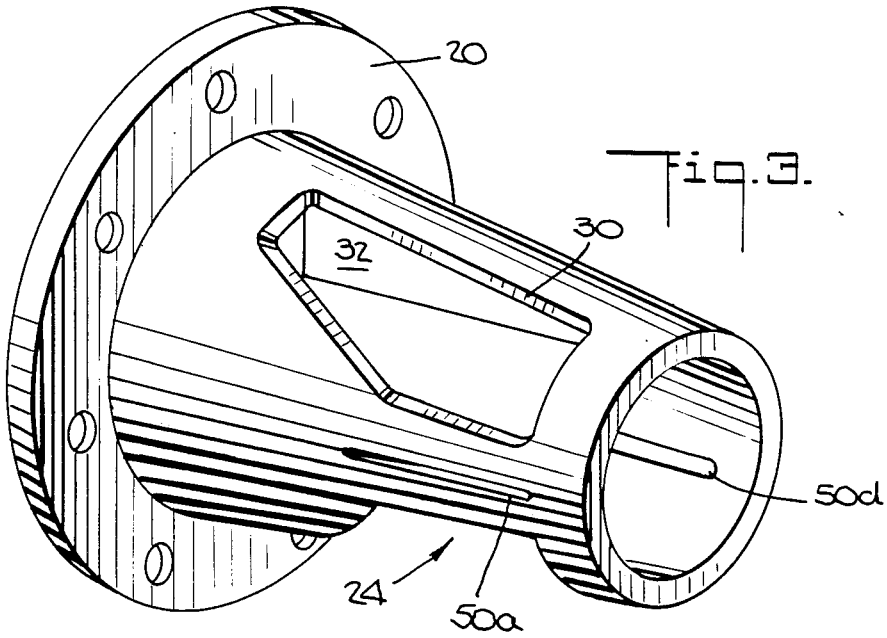
FIG. 3 is a perspective view of the port member of the pump of FIGS. 1 and 2.
Figure 7:
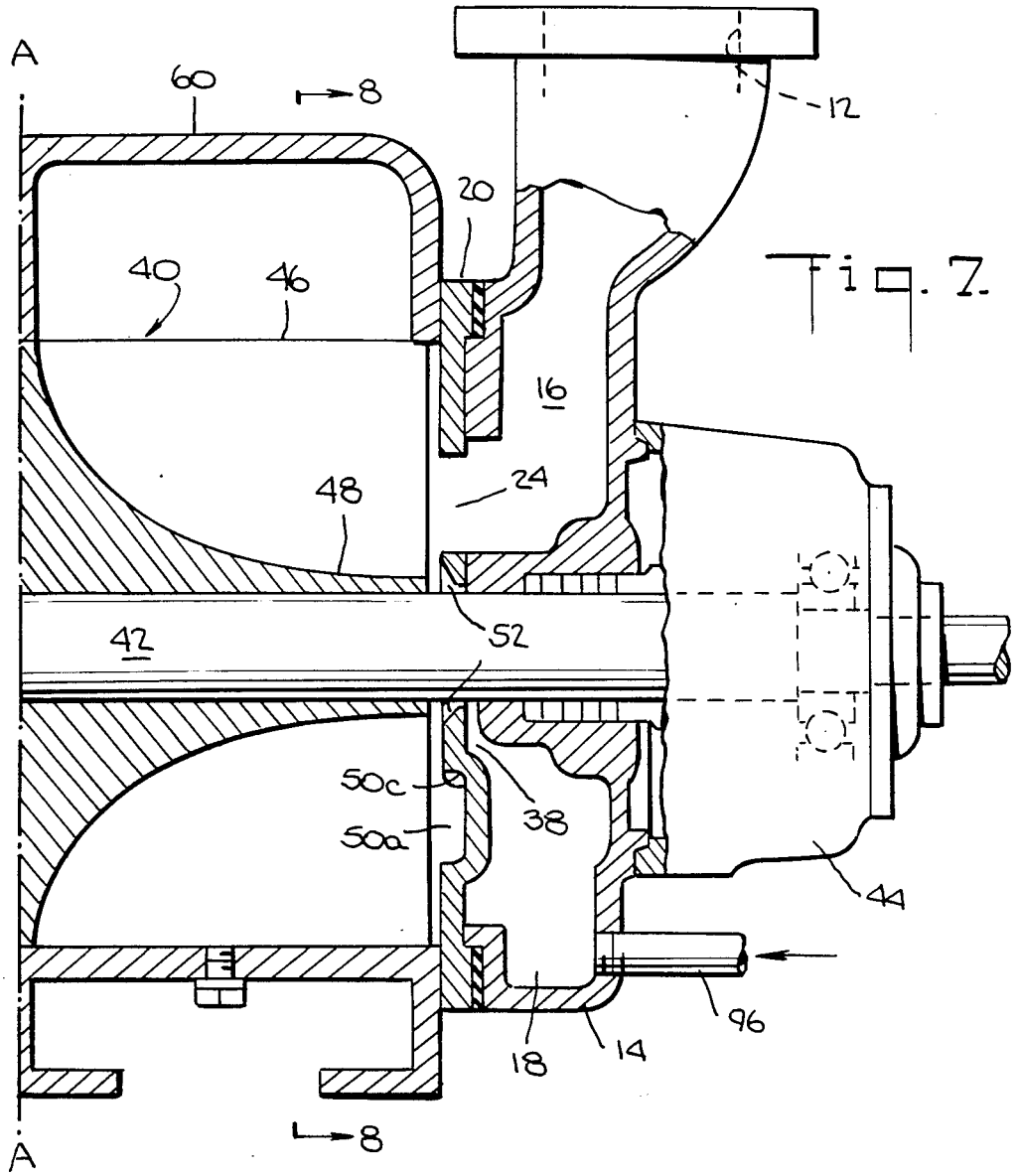
FIG. 7 is a view similar to FIG. 1 showing adaptation of the invention to a side ported liquid ring pump.

In accordance with the principles of this invention, bypass conduit inlet 50*a*, which communicates with the land region of the pump, is below the level 64 of the pumping liquid with which pump 10 is typically started. As shown in FIG. 2, pump 10 is typically filled with pumping liquid to the threshold 62 of outlet 36 in preparation for starting the pump. (This starting pumping liquid level 64 preferably corresponds to the starting and steady-state operating pumping liquid level in separator 80.) Accordingly, starting pumping liquid level 64 is preferably at or slightly above the centerline of shaft 42. This places bypass conduit inlet 50*a* well below starting pumping liquid level 64. Bypass conduit outlet 50*e*, on the other hand, is preferably above the surface 64 of the starting pumping liquid.

When pump 10 is started, it initially tends to discharge a portion of the starting pumping liquid via outlet 36. Because there is no liquid pump to force make-up pumping liquid into pump 10 via conduit 96, the liquid ring forming in the pump tends to be depleted until sufficiently low gas pressure is established adjacent bypass conduit outlet 50*e* to begin to pull pumping liquid into the pump via conduits 96, 18, 38, 50*c*, and 50*d*. On the other hand, because the liquid ring is depleted, the pump is generally unable (in the absence of the present invention) to properly distribute the remaining pumping liquid as a viable liquid ring capable of pumping sufficient gas to establish the pressure differential needed to initiate the inflow of recirculated pumping liquid. This is probably because the liquid ring has receded too far from shaft 42 to seal the pumping chambers near the top of the pump (i.e., from intake port 24 to discharge port 30 in the direction of rotor rotation).

Thus, without the present invention and without a liquid pump to initiate the flow of recirculated pumping liquid into the pump, the pump never forms a proper liquid ring and fails to achieve gas pumping operation, i.e., the pump "stalls".

It has been found, however, that with bypass conduit inlet 50*a* below the starting pumping liquid level, the above-described stall condition during start-up can be avoided without resorting to the addition of a liquid pump to initiate recirculated pumping liquid inflow into the pump. Although the reasons for this are not at present fully understood, it is believed that even before bypass conduit outlet 50*e* is exposed to a sufficiently low gas pressure to begin to pull recirculated pumping liquid into the pump from conduit 96, bypass conduit inlet 50*a* is exposed to a sufficiently high pumping liquid pressure (by virtue of being flooded and also located adjacent the land region of the pump) to cause some pumping liquid from the lower portion of the liquid ring adjacent inlet 50*a* to flow through conduit 50 and re-enter the liquid ring near the top of the pump adjacent to outlet 50*e*. This flow of pumping liquid is believed to help prevent gas leakage and to optimize distribution of liquid within the pump during the relatively brief start-up interval in which the liquid ring is depleted. This enables the pump to form a viable liquid ring and to pump sufficient gas to reduce the gas pressure adjacent outlet 50*e* and thereby begin to pull recirculated pumping liquid into the pump via conduit 96. As soon as the inflow of recirculated pumping liquid is started in this manner, the liquid is quickly replenished and the pump commences full, normal operation. Accordingly, the pump is rendered self-priming by the practice of this invention.

As will now be apparent, conduit 50 performs several related functions. During pump start-up, conduit 50 is believed to convey pumping liquid from its inlet 50*a* to its outlet 50*e* to render the pump self-priming. The portions 50*c*, 50*d*, and 50*e* of conduit 50 also convey the recirculated pumping liquid from conduit 96 into the pump. Conduit 50 also acts as a bypass conduit to improve the volumetric efficiency of the pump.

FIG. 5 shows the preferred locations and relative sizes of bypass conduit inlet 50*a* and outlet 50*e*. Initial conduit portion 50*b* is the same size as inlet 50*a*, and final conduit portion 50*d* is the same size as outlet 50*e*. As mentioned above, inlet 50*a* is adjacent the land region of the pump, and is also below the start-up pumping liquid level of the pump. Axially, inlet 50*a* is preferably disposed in the portion of port member 20 adjacent to which carry-over gas is most likely to occur. In a conically ported pump such as pump 10, this is the smaller diameter portion of port member 20. Angularly, inlet 50*a* is approximately midway between the completion of the compression cycle and initiation of the intake zone.

Outlet 50*e* is located beyond intake port 24 but before discharge port 30 in the direction of rotor rotation. Outlet 50*e* is also preferably substantially larger than inlet 50*a* to promote fluid flow from the inlet to the outlet, and to allow conduit portion 50*d* to accommodate both the fluid from conduit portion 50*b* and the recirculated pumping liquid from conduit 96. Outlet 50*e* is preferably axially long enough to distribute the liquid exiting from it along substantially the entire length of port member 20. This is believed to enhance the sealing effect of the pumping liquid discharged from outlet 50*e* during the self-priming start-up interval.

FIGS. 7–10 show application of the principles of this invention to a side ported liquid ring pump. Although the pump of FIGS. 7–10 is different from the pump of FIGS. 1–5, the same reference numbers are used for generally analogous parts in both pumps. The pump of FIGS. 7–10 can be used as pump 10 in the system of FIG. 6.

The major difference between the pump of FIGS. 7–10 and the pump of FIGS. 1–5 is that in FIGS. 7–10 port member 20 is substantially flat and does not project into any annular clearance between rotor 40 and shaft 42. The inlet 50*a* to bypass conduit 50 is formed as a first radial aperture adjacent the land region of the pump. The outlet of bypass conduit 50 is formed as a second radial aperture 50*e* after the intake port 24 but before discharge port 30 in the direction of rotor rotation. Inlet 50*a* and outlet 50*e* are interconnected by an enclosed passageway 50*c* which is formed for the most part on the surface of port member 20 facing away from rotor 40. Passageway 50*c* is at least partly circumferential of the pump in order to convey bypass fluid around shaft 42 from inlet 50*a* to outlet 50*e*.

Recirculated pumping liquid enters the pump of FIGS. 7–10 via conduit 96 and fills conduit 18 in head member 14. This liquid enters the pumping chamber of the pump (i.e., housing 60) via conduit 38 and an annular clearance 52 between port member 20, on the one hand, and shaft 42 and the axial end of rotor hub 48, on the other hand.

Figure 8:
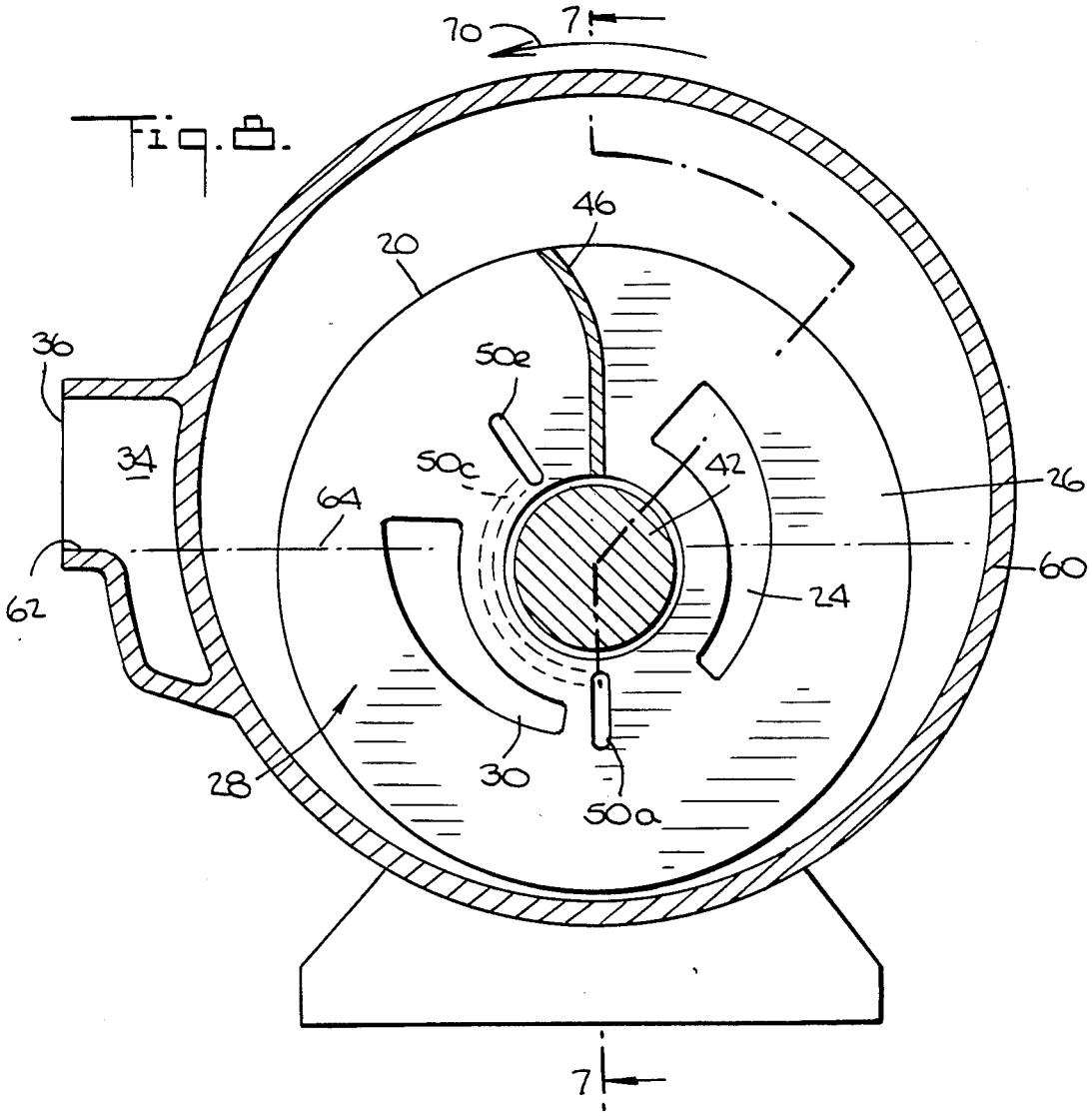
FIG. 8 is a view similar to FIG. 2 for the pump of FIG. 7.
Figure 9:
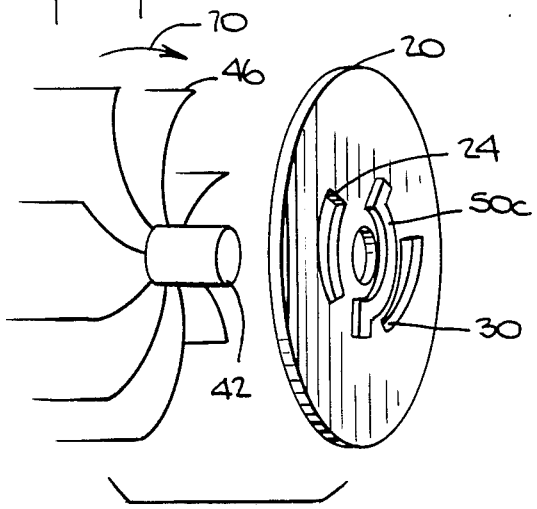
FIG. 9 is an exploded perspective view of two components of the pump of FIGS. 7 and 8.
Figure 10:
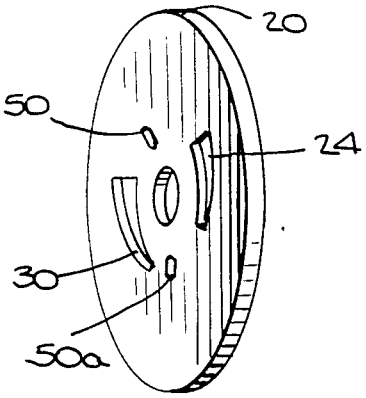
FIG. 10 is a perspective view of the opposite side of one of the components shown in FIG. 9.

Before the pump of FIGS. 7–10 is started, it is partly filled with pumping liquid to a level sufficient to cover inlet 50*a* but not outlet 50*e* (e.g., the level indicated by line 64 in FIG. 8). As soon as the pump is started, the increased pressure produced in the pumping liquid adjacent to inlet 50*a* forces some of that liquid through bypass conduit 50 and out of outlet 50*e*. As in the conically ported pump of FIGS. 1–5, the flow of bypass pumping liquid from outlet 50*e* helps seal the pump between intake port 24 and discharge port 30. This helps the pump establish the gas pressure differential between intake zone 26 and compression zone 28 which is needed to begin to reduce the average gas pressure in the pump and thereby initiate the flow of recirculated pumping liquid into the pump via conduits 96, 18, 38, and 52. The rapidly induced inflow of recirculated pumping liquid ensures prompt and proper liquid ring formation in the pump. After the above-described start-up interval, compressed gas not discharged via discharge port 30 bypasses intake zone 26 by flowing through bypass conduit 50, thereby increasing the volumetric efficiency of the pump as discussed in detail above in connection with the conically ported pump of FIGS. 1–5.

Although the invention has been illustrated in its application to conically ported and side ported liquid ring pumps, those skilled in the art will appreciate that it is equally applicable to other types of liquid ring pumps such as the cylindrically ported liquid ring pumps shown, for example, in Dardelet U.S. Pat. No. 2,344,396. For present purposes, the only difference between conically ported and cylindrically ported liquid ring pumps is that in the latter, the outer surface of the port member (equivalent to the port member 20 shown in FIGS. 1–5) is cylindrical rather than tapered. The basic structure of this invention is therefore directly applicable to cylindrically ported liquid ring pumps.

I claim:

1. A liquid ring pump comprising:
an annular housing;
a gas inlet for admitting to the housing gas to be pumped;
a gas outlet for discharging from the housing pumped gas;
a rotor rotatably mounted in the housing for cooperating with pumping liquid in the housing to convey gas from the gas inlet to the gas outlet; and
a bypass conduit extending from an inlet beyond the gas outlet but before the gas inlet in the direction of rotor rotation to an outlet located beyond the gas inlet but before the gas outlet in the direction of rotor rotation, the bypass conduit inlet being located below the level of the pumping liquid with which the pump is supplied prior to being started from a standstill, the bypass conduit outlet being located above said starting pumping liquid level, and the bypass conduit conveying pumping liquid from its inlet to its outlet during start-up to help the pump establish a gas pressure differential between the gas inlet and gas outlet.

2. The apparatus defined in claim 1 wherein the bypass conduit inlet communicates with any gas not discharged via the gas outlet and conveys said gas to the bypass conduit outlet to prevent said gas from interfering with the admission of gas via the gas inlet.

3. The apparatus defined in claim 1 further comprising:
means for supplying additional pumping liquid to the pump at a pressure approximately equal to the pressure of the gas at the gas outlet so that when a sufficient gas pressure differential has been established between the gas inlet and gas outlet, the additional pumping liquid is pulled into the pump by the relatively low pressure in the pump adjacent the bypass conduit outlet.

4. The apparatus defined in claim 3 wherein the means for supplying additional pumping liquid to the pump is connected to the bypass conduit intermediate its inlet and outlet.

5. The apparatus defined in claim 1 wherein (a) the rotor is mounted on a shaft, (b) at least one axial end portion of the rotor is radially spaced from the shaft, and (c) the pump includes an annular port member surrounding the shaft and extending into the annular space, the gas inlet, the gas outlet, and the bypass conduit inlet and outlet being disposed in the outer surface of the port member.

6. The apparatus defined in claim 5 wherein the bypass conduit passes through the port member.

7. The apparatus defined in claim 5 wherein the inner surface of the port member is radially spaced from the shaft to provide a clearance between the port member and the shaft, and wherein the bypass conduit comprises:
a first portion extending through the port member from the bypass conduit inlet to the clearance;
the clearance; and
a second portion extending through the port member from the clearance to the bypass conduit outlet.

8. The apparatus defined in claim 7 further comprising:
means for supplying additional pumping liquid to the bypass conduit at a pressure approximately equal to the pressure of the gas at the gas outlet so that when a sufficient gas pressure differential has been established between the gas inlet and gas outlet, the additional pumping liquid is pulled into the pump by the relatively low pressure adjacent the bypass conduit outlet.

9. The apparatus defined in claim 8 wherein the means for supplying additional pumping liquid is connected to the clearance.

10. The method of operating a liquid ring pump having (a) an annular housing; (b) a gas inlet for admitting to the housing gas to be pumped; (c) a gas outlet for discharging from the housing pumped gas; (d) a rotor rotatably mounted in the housing for cooperating with pumping liquid in the housing to convey gas from the gas inlet to the gas outlet; and (e) a bypass conduit extending from an inlet located beyond the gas outlet but before the gas inlet in the direction of rotor rotation to an outlet located beyond the gas inlet but before the gas outlet in the direction of rotor rotation, the bypass conduit inlet being located below the bypass conduit outlet, the method comprising the steps of:
providing in the pump while the rotor is at a standstill a quantity of pumping liquid sufficient to submerge the bypass conduit inlet;
rotating the rotor to create a relatively high pressure in the pumping liquid adjacent to the bypass conduit inlet, and to thereby cause pumping liquid to flow from the bypass conduit inlet through the bypass conduit and out the bypass conduit outlet to help enable the pump to reduce the gas pressure adjacent to the gas inlet relative to the gas pressure at the gas outlet; and
supplying additional pumping liquid to the pump at approximately the gas pressure at the gas outlet so that the reduced gas pressure adjacent the gas inlet is effective to pull the additional pumping liquid into the pump.

11. The method defined in claim 10 wherein the additional pumping liquid is supplied to the pump via the bypass conduit.

12. The method defined in claim 10 wherein the bypass conduit inlet communicates with any gas not discharged via the gas outlet, and wherein the method further comprises the step of:
employing the bypass conduit to convey gas not discharged via the gas outlet to the bypass conduit outlet, thereby preventing the gas thus conveyed from interfering with the admission of gas via the gas inlet.

13. The method of operating a liquid ring pump having (a) an annular housing; (b) a shaft rotatably mounted in the housing; (c) a rotor mounted on the shaft, at least one axial end portion of the rotor being radially spaced from the shaft to define an annular space between that portion of the rotor and the shaft; (d) an annular port member surrounding the shaft and extending into the annular space; (e) a gas intake port through the outer surface of the port member for admitting gas to be pumped; (f) a gas discharge port through the outer surface of the port member for discharging pumped gas; and (g) a bypass conduit extending through the port member from an inlet located beyond the discharge port but before the intake port in the direction of rotor rotation to an outlet located after the intake port but before the discharge port in the direction of rotor rotation, the bypass conduit inlet being located below the bypass conduit outlet, the method comprising the steps of:
providing in the pump while the rotor is at a standstill a quantity of pumping liquid sufficient to submerge the bypass conduit inlet but not the bypass conduit outlet;

rotating the rotor to create a relatively high pressure in the pumping liquid adjacent to the bypass conduit inlet, and to thereby cause pumping liquid to flow from the bypass conduit inlet through the bypass conduit and out the bypass conduit outlet to help enable the pump to reduce the gas pressure adjacent to the bypass conduit outlet relative to the gas pressure at the discharge port; and supplying additional pumping liquid to the bypass conduit at approximately the discharge port gas pressure so that the reduced gas pressure adjacent the bypass conduit outlet is effective to pull the additional pumping liquid into the pump via the bypass gas outlet.

14. The method defined in claim 13 wherein the bypass conduit inlet communicates with any gas not discharged via the discharge port, and wherein the method further cmprises the step of:

employing the bypass conduit to convey gas not discharged via the discharge port to the bypass conduit outlet, thereby preventing the gas thus conveyed from interfering with the admission of gas via the gas inlet.

* * * * *